US007866594B2

(12) United States Patent
Eggen

(10) Patent No.: US 7,866,594 B2
(45) Date of Patent: Jan. 11, 2011

(54) FLEXIBLE CONDUIT DISPENSING DEVICE

(76) Inventor: Thomas P. Eggen, 225 Flora Ct., #2, Holmen, WI (US) 54636

( * ) Notice: Subject to any disclaimer, the term of this patent is extended or adjusted under 35 U.S.C. 154(b) by 0 days.

(21) Appl. No.: 12/592,840

(22) Filed: Dec. 2, 2009

(65) Prior Publication Data

US 2010/0084504 A1 Apr. 8, 2010

Related U.S. Application Data

(63) Continuation of application No. 12/220,966, filed on Jul. 29, 2008, which is a continuation of application No. 11/255,845, filed on Oct. 20, 2005, now abandoned.

(51) Int. Cl.
*B65D 85/02* (2006.01)
*B65H 49/00* (2006.01)

(52) U.S. Cl. ..... 242/588.6

(58) Field of Classification Search ..... 242/578.2, 242/607.2, 608, 608.2, 170, 171, 578, 588.3, 242/588.4, 588.6, 598, 598.3, 598.5, 598.6, 242/598.4, 599, 599.3, 129.6, 129.62, 129.7, 242/130, 130.2, 118.5, 578.1
See application file for complete search history.

(56) References Cited

U.S. PATENT DOCUMENTS

| | | | | | |
|---|---|---|---|---|---|
| 3,150,769 | A * | 9/1964 | Cohn | ..... | 242/137 |
| 4,132,372 | A * | 1/1979 | Worrell | ..... | 242/129.62 |
| 4,978,085 | A * | 12/1990 | Letourneau | ..... | 242/588.3 |
| 5,139,210 | A * | 8/1992 | Schaffer | ..... | 242/129 |
| 5,276,310 | A * | 1/1994 | Schmidt et al. | ..... | 219/521 |
| 6,145,781 | A * | 11/2000 | Kawabe et al. | ..... | 242/588.6 |
| 6,736,349 | B1 * | 5/2004 | Boisdon et al. | ..... | 242/578 |

* cited by examiner

*Primary Examiner*—William E Dondero
(74) *Attorney, Agent, or Firm*—M. Paul Hendrickson

(57) ABSTRACT

Coiled cross-linked plastic conduits such as PEX water tubing commonly used by plumping contractors may be effectively unwound and strung at a construction site using a unique conduit dispensing device of this invention. The dispensing device includes a container for housing the coiled PEX conduit and a reel for unwinding the coiled PEX conduit from the container. The dispensing device may be equipped with a suspending mount which when mounted at a dispensing position allows a single worker to more effectively install the conduit at the work site.

14 Claims, 10 Drawing Sheets

FLEXIBLE CONDUIT DISPENSING DEVICE

This application is a continuation application of U.S. patent application Ser. No. 12/220,966 entitled Flexible Conduit Dispensing Device filed on behalf of Thomas P. Eggen on Jul. 29, 2008, which is a continuation application of U.S. patent application Ser. No. 11/255,845 filed on Oct. 20, 2005, now abandoned of the same title and inventorship, both of which applications are hereby incorporated by reference herein.

FIELD OF INVENTION

The present invention pertains to a dispensing devices and more particularly to a dispensing device for dispensing coiled conduits from prepackaged containers and the method of its use.

BACKGROUND OF THE INVENTION

PEX is a long established acronym for a cross-linked polyethylene manufactured by cross-linking a high density polyethylene (HDPE) with cross-linking reagents. It is commonly recognized for decades that PEX piping and tubing defines a cross-linked HDPE cross-linked within a range of 65 to 89 percent cross-linkage as determined by ASTMD2765. The term "PEX" and cross-linked polyethylene or cross-linked HDPE as used and applied herein refers to cross-linked high density polyethylene meeting this 65-89 percent cross-linkage standard. PEX is generally manufactured by three different methods of cross-linking HDPE namely the Engles method (PEX-a), the Silane method (PEX-b) and the radiation method (PEX-c), all of which meet the ASTM, WSF & CSA standards. PEX pipe, PEX piping, PEX tubing, PEX, PEX tube, plumb PEX and heat PEX are generally recognized as referring to the same product.

Although PEX piping is referred to as possessing flexible attributes, its flexibility is severely limited because of its cross-linked structure. The PEX cross-linked structure converts the uncross-linked thermoplastic HDPE possessing excellent winding and rewinding flexibility into a thermoset plastic which drastically alters its physical properties imparting an inability to effectively bend around objects, wind or unwind from a common reel. Unlike conventional polyethylene tubing which possess sufficient flexibility to allow the high density polyethylene tubing to be freely bent, wound and unwound from a reel, PEX piping cannot be wound or unwound from a spool or a spool wound form. Excessive bending or abrupt angular bending can collapse or damage the PEX tubular structure. The pronounced 65-89% cross-linkage structure of PEX pipe imparts thermoset characteristics which prevents PEX from being windable about or unwindable from a spool or reel. The inability to effectively wind or unwind PEX becomes further complicated by the fact that the high density polyethylene cross-linkage imparts a spring-like memory character onto the conventionally factory manufactured strapped PEX coils. Thus upon a cutting of the factory bound straps, the PEX coil tends to uncoil into a larger sized coil patterned after its inherent memory properties which creates particular difficulties and tediousness in order to maintain the coil in a suitable form for effectively installing the PEX tubing at the work site. The PEX installer must accordingly undertake extraordinary precautionary measures to maintain the PEX in a manageable form while creating or imparting a new memory character by realigning the PEX coil to match the installation thereof at the work site. Imparting a new memory configuration forcibly realigning the coil involves time and anchoring of the PEX piping a desired installation configuration so as to establish the newly acquired memory configuration for the PEX piping. This is most difficult because the coiled PEX piping inherently resists restructuring into an uncoiled form, must be forced into a newly acquired configuration and tends to snarl itself into an unworkable mess if not handled under carefully controlled installation conditions. Thus, the plumbing installation will often require at least two laborers or more depending upon the installation conditions.

It is also conventional to string continuous flexible (PEX) conduit along the floor joists so as to provide the necessary utility systems in new and old constructions. PEX pipe has served as a replacement to copper tubing and piping in various different types of construction. PEX tubing or piping is commercially available in imperial sizes ranging from ¼ inch up to 4 inch size with the ½, ¾, and 1 inch sizes being the most common for residential uses. PEX is commonly used in hydronic radiant heating systems, domestic water piping, insulation for high tension (high voltage) electronic cables, natural gas, off-shore oil applications, chemical transportation, sewage and sludge transportations, etc.

Continuous coils of cross-linked high density polyethylene (PEX) tubing for use in hot and cold water systems are commercially available in 300 and 1000 foot lengths of continuous PEX piping or PEX tubing coils for use by the plumbing contractor. The 300 foot coiled PEX conduits are lighter and easier to handle than the industrialized 1000 foot PEX size and are generally preferred for use especially in the smaller commercial and residential projects. The prepackaged coiled PEX conduits are indexed with footage markings so as to enable a worker to ascertain the remaining amount of coiled PEX conduit and footage actually used at any given construction site. Typically, a 300 foot continuous PEX coil of PEX water tubing (e.g. such as AQUAPEX®, a cross-linked high density polyethylene tubing (PEX) sold and distributed by Wirsbo Company, an Illinois Corp., having a principal business address at 5925 148$^{th}$ Street West, Apply Valley, Minn., often complimented with a hePEX™ coating serving as an added oxygen barrier coating) will be boxed and shipped in a rectangular cardboard box measuring about 32 inches square in widths ranging from 4, 6, and 10 inches in 300 foot lengths respectively for ½", ¾", and 1" diameter tubes. A boxed and cinched strapped 300 foot of ½ inch PEX coil will typically weigh about eighteen pounds, while a ¾ inch diameter packaged PEX coil weighs about 34 pounds and a one inch prepackaged PEX coil weighs about 56 pounds. In contrast a 500 foot prepackaged PEX coil of one inch diameter PEX tubing will weigh about 94 pounds and accordingly packaged in a container of a wider width to accommodate the larger sized coiled PEX conduit size. In conventional practice, the plumbing contractor will either remove or open the top panel flap of the cardboard box so that, after cutting the binding straps, the outermost PEX tubing free-end may then be unwound from the PEX coil. The most typical procedure involves dispensing the uncoiled PEX water tubing from an open top flap of the shipping box which continues until the PEX tubing ultimately rips through the bottom of the box. As the PEX tubing is unwound from the PEX coil, it is then typically strung and secured under physical manipulation to floor joists by conduit or joist staples or by drilling conduit holes through the floor joists so as to provide the necessary PEX conduit for the water supply system. The stringing process typically commences at one of the terminating ends of the water system and then stringing towards the water source or vice versa. With use, dragging the heavy PEX conduit box across floors, such as concrete basement floors, ultimately damages or destroys the shipping container so it is no longer useful to box the unused PEX coil. The coiled PEX water tubing is poorly suited to be dispensed from the original shipping container in this manner. There exists no suitable dispensing device for PEX piping at the work site.

Because of its uniquely intrinsic properties, it is also not an easy task to uncoil the relatively stiff PEX water tubing from the PEX tubing coil while also trying to string the uncoiled tubular PEX conduit through holes bored through floor joists or onto the PEX conduit anchoring or suspending sites. The PEX water tubing becomes considerably more stiffer and less flexible in cold weather because of its unique cross-linked structure. Often, it becomes necessary to interrupt the stringing process to unkink or untangle a snarled PEX coil or to fix a damaged PEX conduit before proceeding any further with the stringing of PEX conduit along the floor joints. If the entanglement becomes too severe, it may become necessary to splice a damaged PEX tube section so as to retain the necessary continuity in the PEX piping or water system. If the PEX conduit container or shipping box fails to contain the coiled PEX conduit, the PEX conduit is prone to errantly uncoil into a tangled mess which then becomes most difficult to manage and string. Invariably, it becomes necessary in normal operations to remove the last 150 feet or so of coiled PEX conduit from the shipping container with the assistance of at least two workers to unravel and uncoil the coiled PEX conduit so that it may be effectively strung onto the floor joists. Under the prior art practices, the entire unreeling procedure is at best tedious and fraught with many difficulties which impede effective stringing of the PEX conduit.

The current system for stringing continuous conduits of PEX water tubing is time consuming and if not done with the most appropriate care, can lead to premature uncoiling of the PEX conduit, damage or splicing of the PEX water tubing or other costly delays. In order to facilitate the unwinding of the coiled PEX tubing, it is often advantageous to have one worker pulling or stringing the PEX water tubing along the stringers or floor joists while another worker tends to the unwinding of the coiled PEX tubing. A procedure or device which would allow a single worker to effectively uncoil the PEX conduit and install the system at the construction site would be of particular value and usefulness.

There accordingly exists a need for a PEX conduit dispensing device which would allow a single worker to effectively unwind and install a PEX conduit system along the floor joist or other suitable mounts. A PEX dispensing device which would uniformly and unerringly unwind the coiled PEX conduit from its coiled structure or source while allowing a single worker to string, staple or thread the required PEX tubing to the anchoring joists as needed would significantly reduce installation costs and reduce damage to the PEX tubing. There also exists a need for a device which more expeditiously establishes a desired new memory configuration to an unwinding PEX coil under the diverse conditions arising at a PEX installation site.

SUMMARY OF THE INVENTION

Pursuant to the present invention, there is provided a flexible conduit dispensing device for dispensing a coiled PEX conduit which in its manufacture is normally wound about a spool to create an open cavity and then prepackaged in a shipping container at the manufacturing site. The PEX dispensing device of this invention includes a reel for uncoiling the coiled PEX conduit, a suspending member for suspending the dispensing device at a predetermined dispensing position at a work site, and a confining member for confining the coiled PEX conduit and dispensing the uncoiled PEX conduit therefrom. The reel allows the coiled PEX conduit to be uniformly unwound and effectively dispensed at the work site. The confining member for the coiled PEX conduit serves to protectively house and contain the coiled PEX conduit while also allowing it to be expeditiously unwound from the reel as needed at the work site. The confining member may serve as a mount for the reel and as suspending member or the confining member may be reinforced with a frame to support the reel, the suspending member and the confining member when the confining member or container fails to provide sufficient structural strength.

When a shipping container for the coiled PEX conduit is used as the container or confining member, the dispensing device will advantageously include a confining member jacket or a frame for retaining the shipping container in a dispensing position. The frame may also serve as a mount for both the dispensing reel and the suspending member. When a frame is required, the frame may be appropriately designed as a bracket to engage onto a top and side panels of the coiled PEX conduit container and retain the dispensing device in a suitable uprighted position for uncoiling and stringing the PEX conduit from the container. A forked bracket with extending legs laterally disposed downwardly bridging the top panel saddling the side panels and equipped with reel mounts for rotatably mounting the reel therebetween affords an operative combination of dispensing device components for effectively unwinding and dispensing the straightening resistant conduit from the device at the dispensing site. A PEX container jacket for housing the more fragile PEX containers may be equipped with mounts for both the reel and the suspending member.

The PEX dispensing device as utilized at the work site includes a suspending member which allows the utility contractor to mount the dispensing device at the most suitable site for stringing the conduit at the work site such as along a floor joist. For the heavier coiled PEX conduits, a floor supported mount for the dispensing device may be used. For lighter loads, a hanger suspended or anchored to a floor joist is highly effective.

The dispensing device of this invention allows a plumbing contractor to unwind a prescribed amount or length of the PEX plastic water tubing while maintaining an appropriate level of tension upon the contained coiled PEX tubing so as to effectively string and anchor the PEX water tubing onto the floor joists. The coiled PEX conduit by itself possess an inherent lubricity which assists to some degree in the uncoiling operation. Unfortunately, the weight of the coiled PEX conduit coupled with its inherent spring-like inherent memory characteristics, and the amount of friction created by the coiled PEX conduit rubbing against the shipping box or container especially renders it tedious to unstring the PEX conduit from the box during the stringing operation. The heavier coiled PEX conduits further accentuate this problem. The reel in cooperative combination with the confining member assists the site worker in effectively drawing the coiled PEX tubing from the coiled PEX conduit and reestablishing a desired new memory configuration for the PEX tubing installation at the construction site. The reel serves to suspend the coiled PEX conduit while significantly reducing the strain and effort required to uncoil the PEX conduit at the work site.

The dispensing device reduces the manpower and time required to properly install the PEX conduit at the work site while also allowing a single worker to expeditiously complete the task. Since the PEX dispensing device maintains the coiled PEX tubing in its indigenous wound or memory condition and only dispenses the desired feed amount of PEX conduit at the work site, entanglement and inadvertent damage of the coiled or uncoiled PEX tubing are essentially eliminated through the use of the dispensing device of this invention.

A common use of the dispensing device will involve unpacking the coiled PEX conduit sufficiently to permit a reel to be inserted at a position which allows the coiled PEX conduit to be freely suspended (i.e. not resting upon the container bottom) within the PEX container for unreeling. For certain applications, the original shipping cardboard container may be modified to serve as a confining member for the PEX dispensing device. A reel shaft port positioned along an imaginary line vertically bisecting the container and vertically positioned so as to freely suspend the coiled PEX conduit upon the reel within the box may be generally accomplished by placing the reel axle or shaft about 1-2 inches above the side panel centroid. In practice, the factory installed PEX coil binding straps are typically cut at the work site and discarded so as to permit the coiled PEX conduit to be unreeled from the uncoiling reel. The coiled PEX conduit with the unreeling reel is then placed in a suitable dispensing container and suspended at the work site at an appropriate dispensing position.

When the original shipping container for the coiled PEX conduit is used as the confining member, a frame as depicted by the FIGS. 1-5 may be used to provide the necessary supportive structure. After reinserting the coiled PEX tubing into the cardboard shipping box which is used as a container, a forked member is placed over the top and side panels of the box so that the shaft receiving apertures of the forked member is aligned onto the holes ported into the side panel of the container. The threaded reel shaft may be inserted into port and reel retaining or shaft receiving apertures with shaft nuts then being threaded onto the threaded shaft to secure the frame to the reel and container. The hanger is then anchored to a suitable dispensing site.

DETAILED DESCRIPTION OF THE INVENTION

Figure 1:
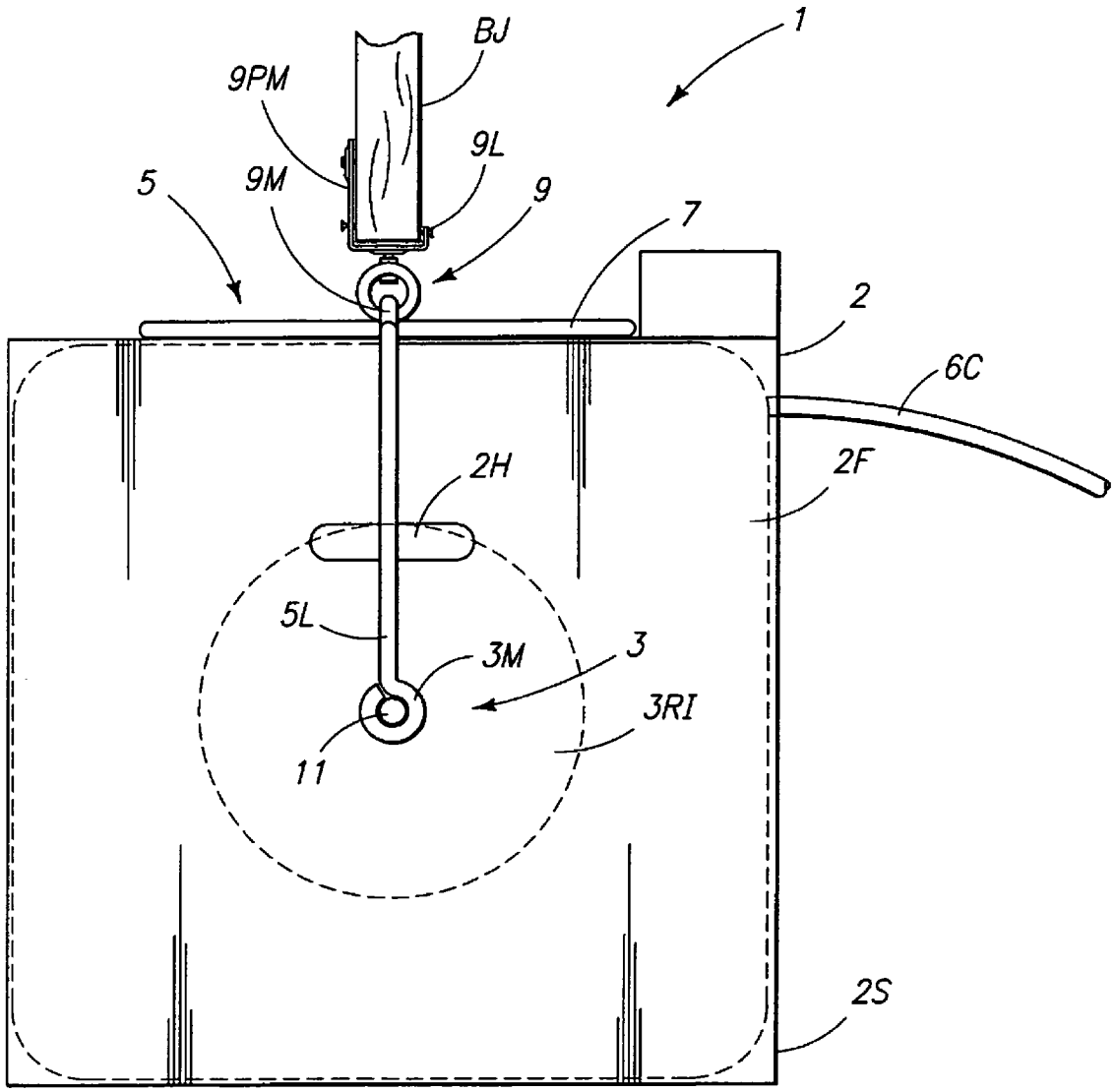
FIG. 1 is an elevational side view depicting a dispensing device of this invention positioned in a dispensing position for installing an uncoiled PEX conduit being fed from the dispensing device.

With reference to the Figures, there is provided pursuant to the present invention a dispensing device 1 comprised of a confining member 2 for housing a coiled PEX conduit C and dispensing an uncoiled PEX conduit C therefrom, a suspending member 9 for suspending the PEX dispensing device 1 at a predetermined dispensing position at a work site and a reel 3 for uncoiling the coiled PEX conduit C from the dispensing device.

The dispensing device 1 allows the coiled PEX conduit C to be effectively dispensed from a confining member 2 such as the depicted confining container 2 without being handicapped by the inherent deficiencies of the prior art. The PEX conduit dispensing device 1 depicted in FIGS. 1-5 includes a modified shipping container 2 for containing the coiled PEX conduit C, a reel 3 for spooling the coiled PEX conduit C and a frame 5 for retaining the coiled PEX conduit C at a suitable uncoiling position. Frame 5 further includes a bracket 6 for bracketing and retaining the modified container 2 at the predetermined dispensing position and a reel mounting member 3M for rotatably mounting the reel 3 to the frame 5 and a hanger 9 for securing the frame 5 at the dispensing position at a work site.

Figure 5:
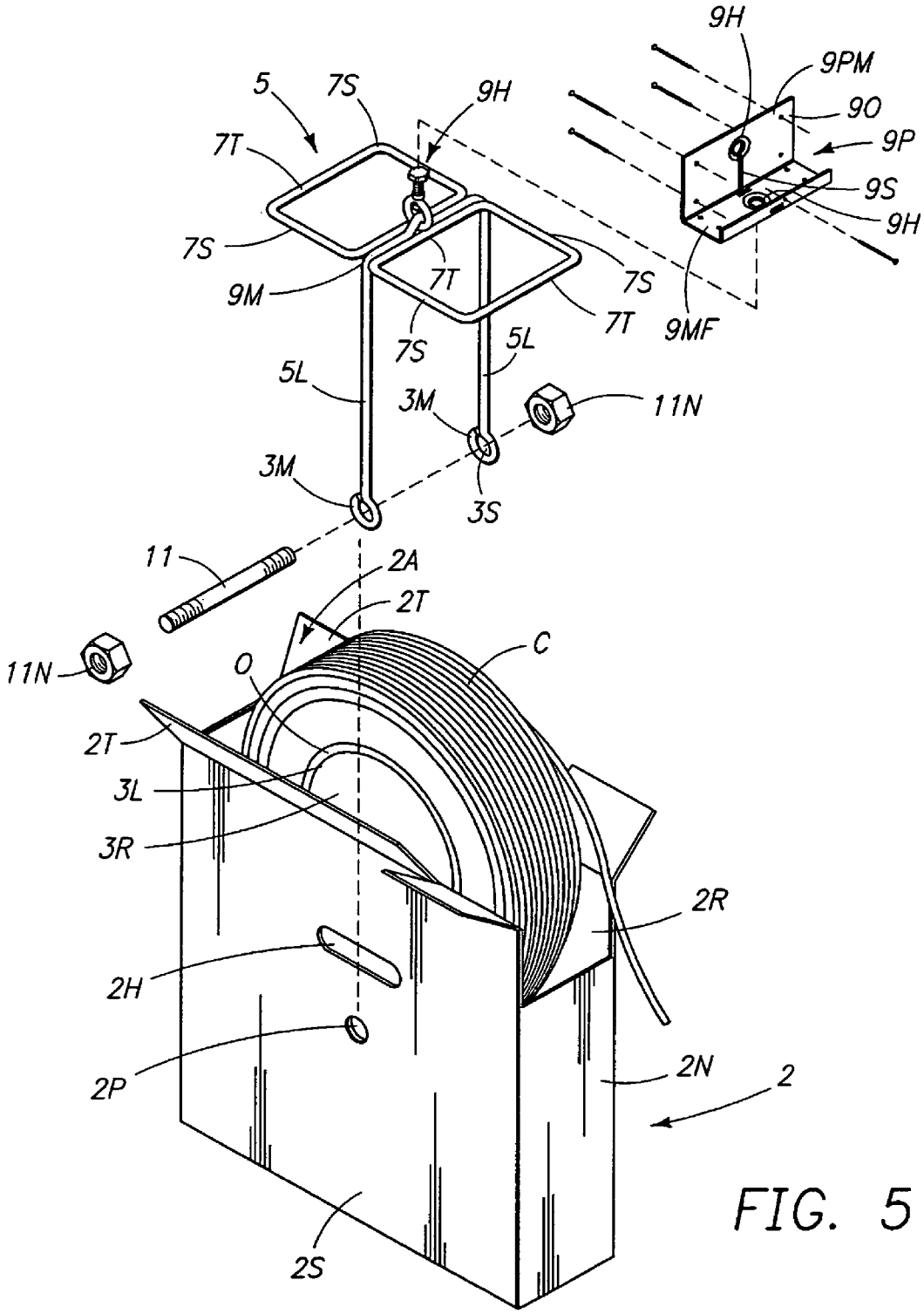
FIG. 5 is a partially disassembled elevational view of the dispensing device shown in FIG. 1.

The conduit dispensing device 1 will most appropriately be of a design and construction which contains and allows the coiled PEX conduit C to be unreeled while minimizing the effect of drag upon the coiled PEX conduit C during the unreeling operation. The reel 3 allows the coiled PEX conduit C to more freely rotate and unwind from the dispensing device 1 without incurring a substantial amount of drag so as to adversely interfere with the unwinding from reel 3. To accomplish this unreeling efficacy of the coiled PEX conduit C, the reel 3 may be suitably designed so as to axially suspend the coiled conduit C within the dispensing device to alleviate excessive drag. The reel axle 11 may be suitably positioned within the container 2 so as to freely suspend the coiled PEX conduit C upon the reel 3 within container 2. By placing the reel axle mount 3M or support at a sufficient lateral placement directly above the centroid of the container side panel 2S, sufficient clearance within the container 2 may be accomplished so as to allow free rotation of the reel 3 and the coiled PEX conduit C. The shaft 11 as depicted in FIG. 5 includes a pair of nuts 11N which when threaded onto threaded shaft 11 retains shaft 11 within axles mounts 3M.

The PEX conduit dispensing device 1 of this invention is particularly applicable to coiled PEX conduit C such as commonly used to install utility systems such as potable water systems to residential, commercial and industrial buildings. The coiled PEX conduits C are conventionally strapped together at the factory site with gathering or binding straps and prepackaged in a cardboard box shipping container for commercial shipment to retail or wholesale outlets. Continuous PEX coils C of cross-linked plastic tubing such as commonly used by plumbing contractors are particularly illustrative of such prepackaged coiled PEX conduits C for use with the dispensing device of this invention.

Such coiled PEX plumbing conduits C are typically coiled in 300 and 1000 foot lengths at the manufacturing site by winding a continuous tube of thermally heated conduit treated with a cross-linked reagent about a 14¾ inch diameter spool or drum, wound to about 2½ foot in diameter coil C. The conduit PEX coils C are bound together with plastic binding straps and then packaged in a cardboard shipping box all of which are a standardized square side panel 2S size. The precoiling of the PEX conduit C creates an open center or cavity typically measuring about 15 inches in diameter. The lateral width of the lateral side panels 2N of such standardized square packaging containers will typically be widened or narrowed so as to accommodate for the different commercial lengths and sizes of the coiled PEX conduit C.

Figure 8:
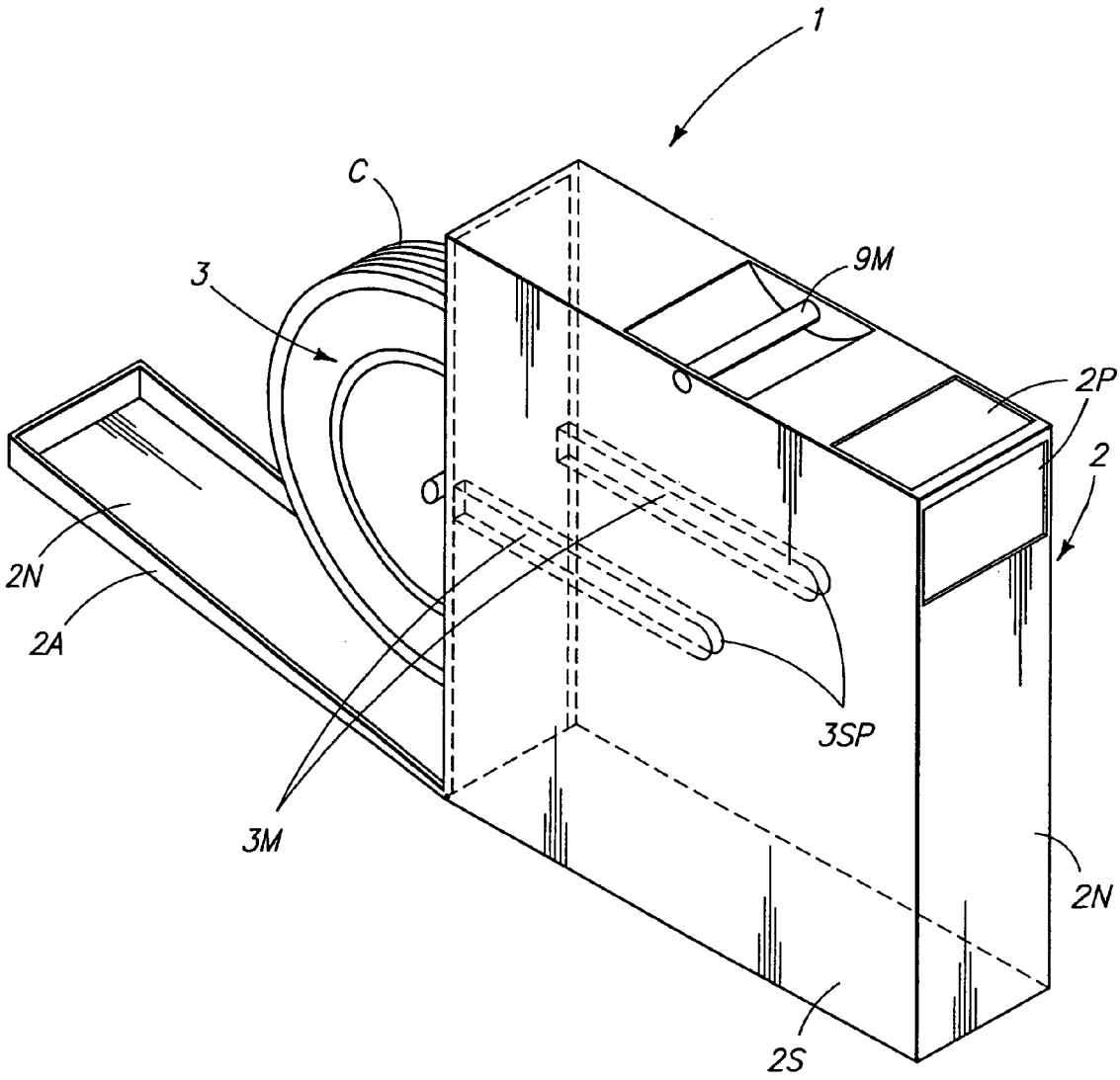
FIG. 8 depicts an elevational view of another embodiment of the dispensing device of this invention shown in FIG. 1.
Figure 9:
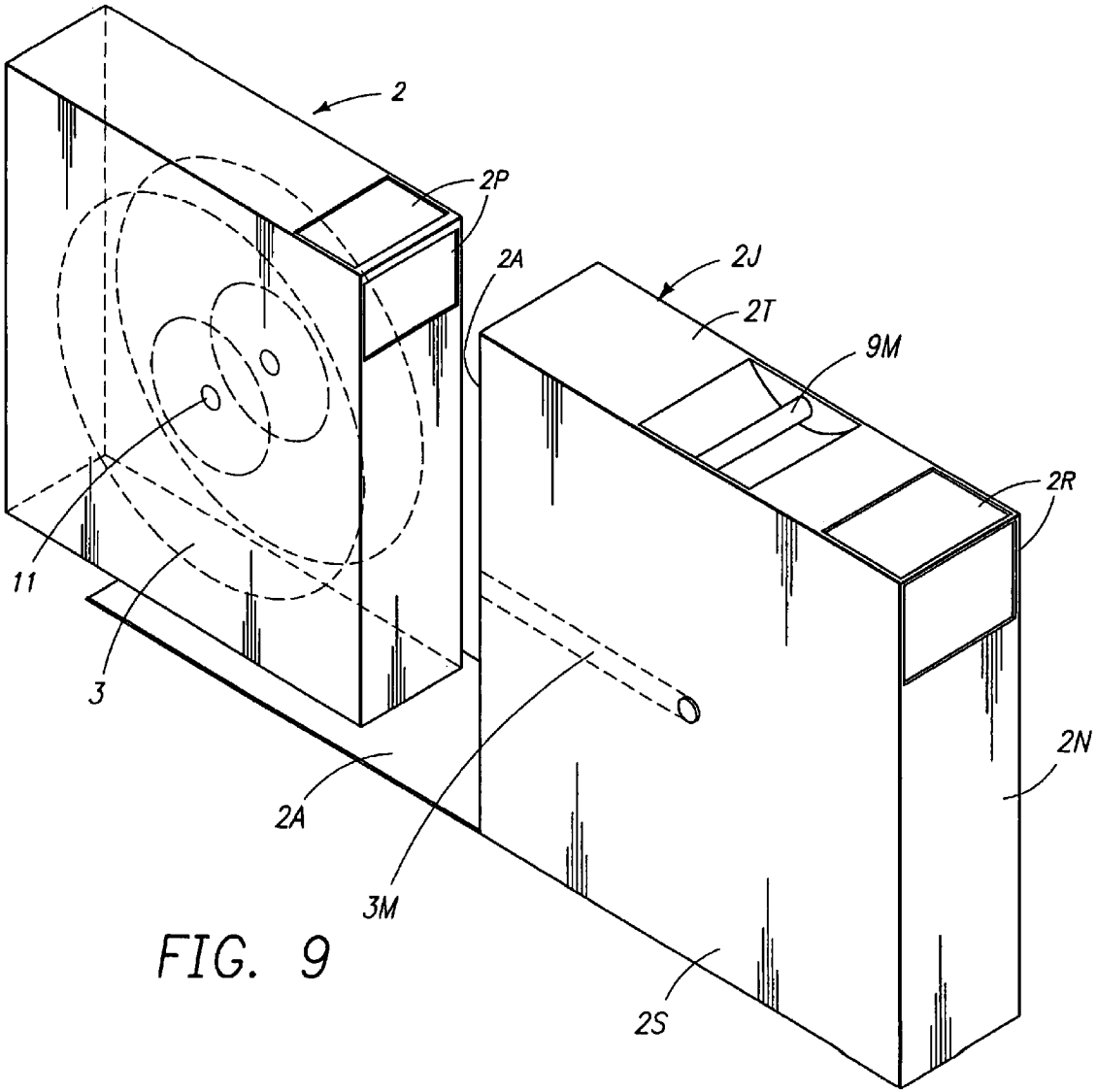
FIG. 9 is a frontal elevational view of another dispensing container for the dispensing device of this invention.

It is customary to use such original cardboard shipping containers for stringing the PEX conduit C at the work site. The original shipping containers easily tear and disintegrate before the stringing task can be effectively completed. In the embodiments of the invention as depicted by FIGS. 1-5 and 9, the original cardboard shipping container may be modified so as to serve as a useful dispensing container 2 herein. This may be accomplished by providing a more sturdy mount for both the reel 3 and the suspending member 9. A frame 5 such as illustrated by FIGS. 1-6B serves as suspension mount 9M and reel mount 3M when the modified shipping container 2 is desired to be used as the confining member 2. Alternatively, a more rigid confining member 2 as depicted in FIG. 8 or a more durable external container jacket 2J as depicted by FIG. 9, may serve to suspend the dispensing device 1 and support the reel 3 when the modified shipping container 2 is used. In both instances, either the frame 5 or the container jacket 2J provides the necessary structural integrity to serve as the reel mount 3M and the suspending member mount 9M. FIGS. 8 and 9 respectively depict a confining member 2 and a container jacket 2J which, if desired, serve as a reel mount 3M and the suspending member mount 9M. The modified cardboard shipping container 2 will generally require modification and auxiliary supportive equipment such as the supportive frame 5 depicted by FIGS. 1-5 or a container jacket 2J as depicted by FIG. 9. The confining member 2 illustrated by FIGS. 8 and 9 illustrate the versatility of the invention. The FIG. 8 depicting illustrates the use of the confining member to house the coiled PEX conduit C carried by reel 3 while the container jacket 2J shows how the invention may be adapted to receive a pre-manufactured cassette equipped with a modified shipping container 2 fitted with a reel 3, coiled PEX conduit C, shipping container and reel mount 3M or used to house an original modified container 2 equipped with the various different types of reels 3 disclosed herein.

The containing or confining member 2 serves to contain the coiled PEX conduit C for the uncoiling operation. The container 2 housing the reel 3 and the coiled PEX conduit C are designed to retain or contain the coiled PEX conduit C while also allowing the PEX conduit C to be uncoiled from the confining member 2. Any container 2 which serves to house and confine the coiled PEX conduit C may be utilized for this purpose. The housing container 2 may be of an open structure such as a spooked or bracketed container or jacket or of a preferred enclosed structure as depicted in the Figures.

The confining member 2 preferably provides an accessing port 2A (open or closable port) which allows for accessing onto the coiled PEX conduit C and placement of the coiled PEX conduit C upon the reel 3 or for the removal of the coiled PEX conduit C therefrom. When the cardboard shipping box is used, the top panel members 2T of the modified shipping container 2 affords a suitable accessing port 2A for accessing onto the coiled PEX conduit C and the reel 3. The modified container 2 will also be equipped with an open unreeling port 2R which allows the PEX conduit C to be effectively unreeled from the container 2. The unreeling ports 2R as illustrated by FIGS. 1-3, 5 6A, 6B, 8 and 9 corners onto the lateral side panel member 2N and top panel 2T of the container 2 so as to allow for uncoiling of the coiled PEX conduit C at the most appropriate dispensing position (e.g. a top corner) such as when hanging or anchoring of the PEX conduit C to the floor joist.

As may be observed in FIGS. 1-5, the modified container 2 may be of a closed construction such as the modified cardboard shipping box 2 equipped with an access port 2A to provide access onto the PEX conduit C and permit unbinding cutting of the shipping straps, placement of the coiled PEX conduit onto the reel 3 and the ultimate uncoiling of coiled PEX conduit C through a dispensing port 2R. It will be further observed that the depicted modified container 2 may be modified to include, if desired, hand slots 2H which facilitate the handling of the coiled PEX conduit C and manipulation of the dispensing device 1 at the work site. The confining member 2 may be alternatively provided in suitcase form (not shown) such as two hinged sections equipped with confining sidewalls fitted with mating split reel sections and an unreeling port 2R which when opened would allow the container 2 to be loaded with the coiled PEX conduit C and when closed provides an unreeling reel 3 for the coiled PEX conduit C. Although not currently commercially available, factory produced containers could be modified so as to include the reel 3 and dispensing port 2R so as to allow the plumbing contractor to merely insert a factory modified container 2 of a cassette form into a jacketed container (e.g. see FIG. 9) or onto the supportive frame 5 of FIGS. 1-5.

Figure 2:
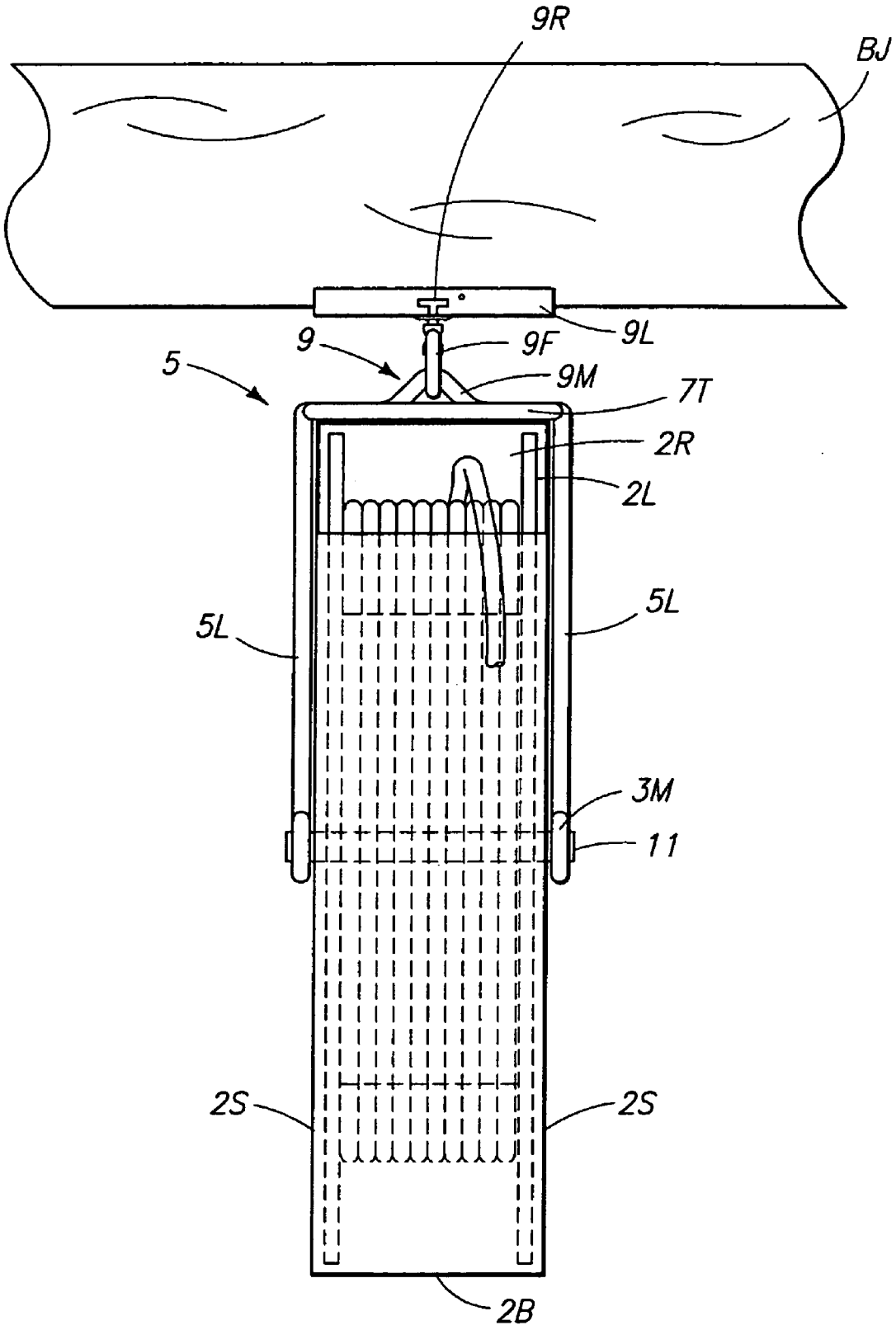
FIG. 2 is a frontal view of FIG. 1.
Figure 3:
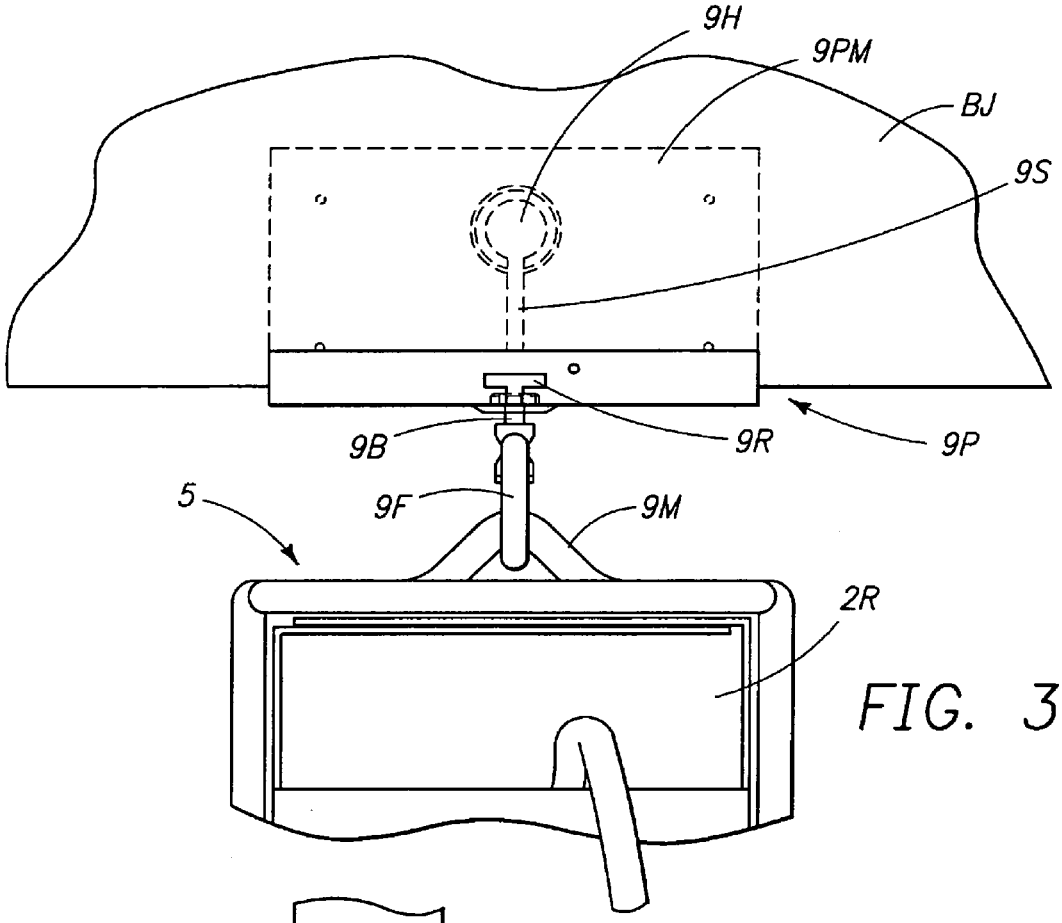
FIG. 3 is an enlarged partial view of FIG. 2.
Figure 8A:
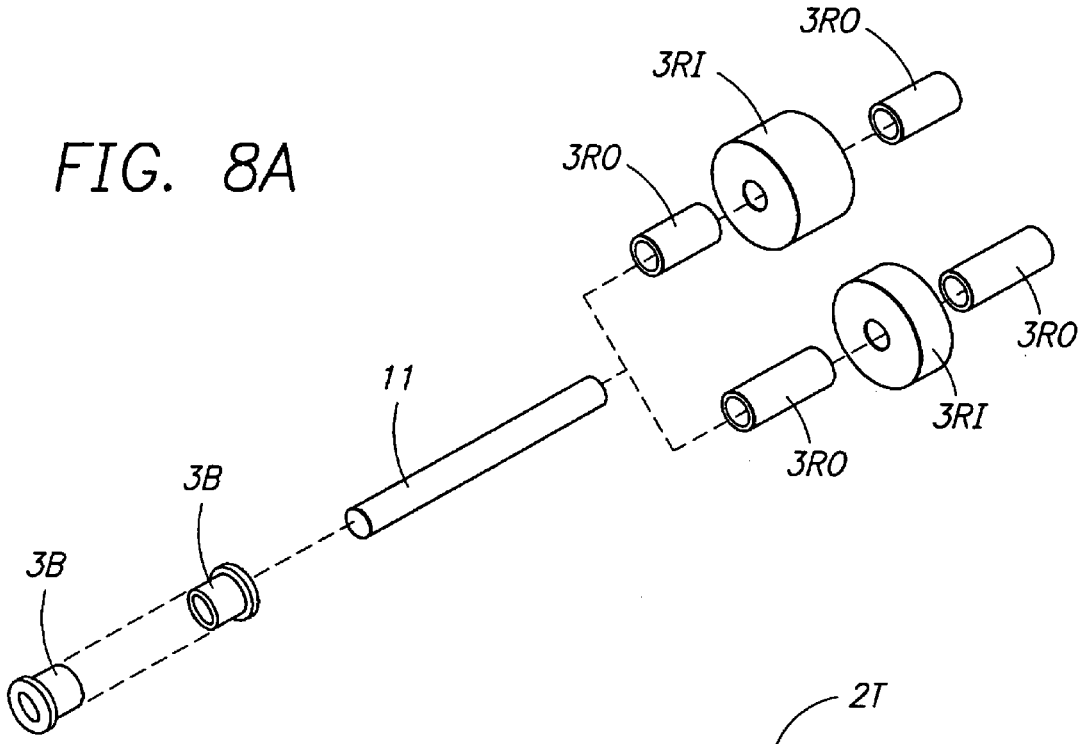
FIG. 8A is an exploded isometric view of component parts for an adjustable reel suitable for use with the PEX conduit dispensing device of this invention.
Figure 8B:
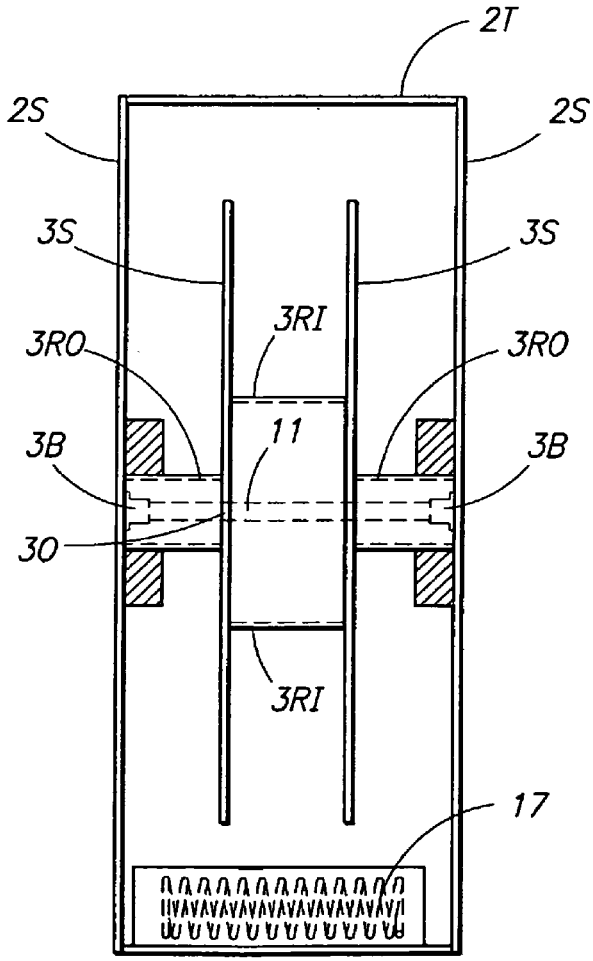
FIG. 8B depicts a cross-sectional frontal view of the dispensing device shown in FIG. 8 equipped with the adjustable reel of FIG. 8A.
Figure 8C:
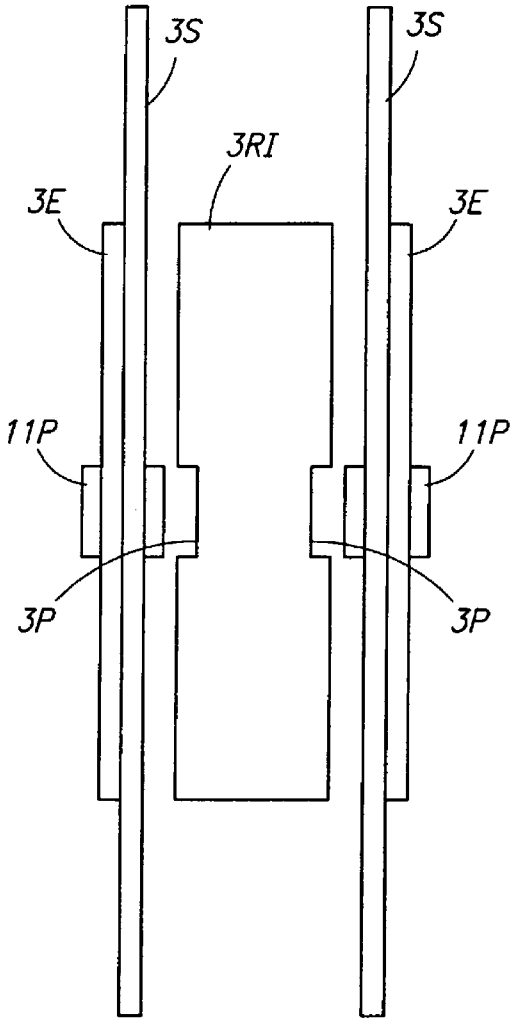
FIG. 8C depicts a frontal view of another adjustable reel adaptable for use with the conduit dispensing device shown in FIG. 8.
Figure 8D:
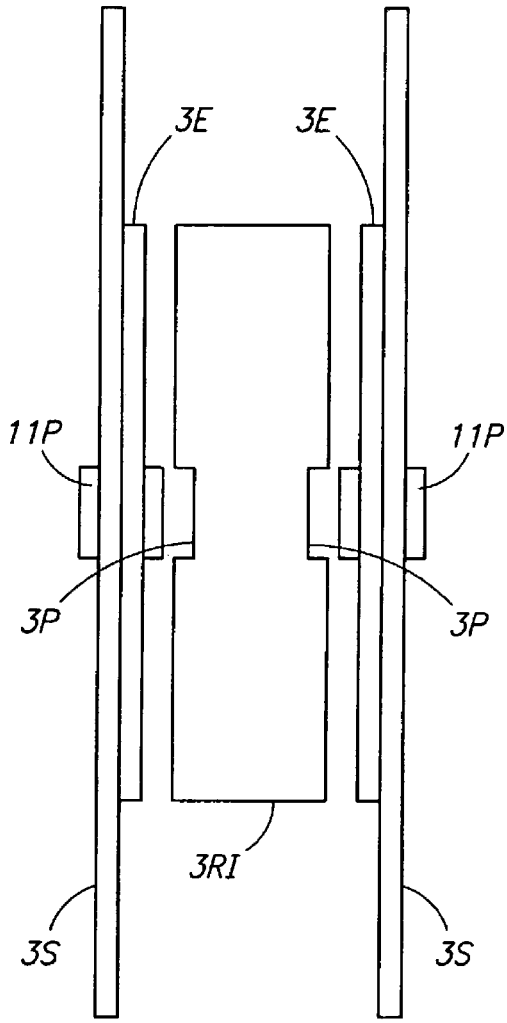
FIG. 8D depicts the adjustable reel shown FIG. 8C adjusted so as to accommodate a larger sized coiled PEX conduit.

The phantom lines of FIGS. 1-3, 6A, 6B, 8, 8B, and 9 illustrate internally disposed components occluded from external view as shown in the Figures. The occluded views include the coiled PEX conduit C axially supported by reel 3 as depicted by the phantoms lines of FIGS. 1, 6A, 6B, and 9. Friction reducing side panel liner inserts 2F (such as depicted by the phantom lines shown in FIGS. 1-2, 6A and 6B) are designed to reduce friction between the interfacing surfaces of the coiled PEX conduit C and modified container 2. A pebbled surfaced PVC wall board (e.g. PLAS TEX, polywall panel, 0.006 thickness, matt texture, of Parkland Plastics Inc., 104 Yoder Drive, Middleburg, Ind. 46540) will effectively serve to significantly reduce friction caused by the coiled PEX conduit C rubbing against the inside panels 2S of the modified container 2. An occluded view of mounting plate 9P is also shown in FIG. 3. The phantom lines of FIG. 8 depict the internal cornering edges of container 2 and a channeled axle mount 3M for slideably receiving a reel axle shaft 11 or axle shaft projections 11P as depicted in FIGS. 8C and 8D.

The depicted embodiments of the invention of FIGS. 1-6B show a conventional cardboard box shipping container for the coiled conduit which has been modified for retaining the coiled PEX conduit C and effectively permits its unwinding through an unreeling port 2R from reel 3. The dispensing device 1 as depicted in FIGS. 1-6B effectively protects the relatively fragile modified shipping container 2 from damage during its use to dispense uncoiled PEX conduit C. The modified container 2 may be appropriately modified so as to include a reel axle port 2P for receiving axle shaft 11, a dispensing port 2R, all of which may be incorporated into the original shipping container to render it adaptable for use as a modified container or confining member 2 for the dispensing device 1 herein. Since the frame 5 protects and prolongs the useful life of the modified container 2, the modified container 2 is protected against premature damage and may be reused several times before it becomes excessively worn for reuse. This avoids the need to modify each new container each time it is necessary to dispense a new PEX coil C. Thus, the coiled PEX conduit C as conventionally obtained from the original shipping container may be transferred to the modified container 2 as depicted by FIGS. 1-5 each time it becomes necessary to replenish the dispensing device 1 with fresh coils.

When it becomes necessary to insert a fresh coiled PEX conduit C into the dispensing device 1, the coiled PEX conduit C with the inserted reel 3 may be prepared for reuse by cutting the binding straps F and inserting the coiled PEX conduit C onto reel 3 into the previously used and already modified cardboard container 2 as depicted by FIGS. 1-5. The axle ports 2P, the reel axle receiving apertures 3P and frame axle mounts 3M are placed in alignment so that the axle shaft 11 may be mounted for dispensing the coiled PEX conduit C from the dispensing device 1. The frame 5 as shown in FIGS. 1-5 as well as the hard shell container (e.g. see FIG. 9) effectively prolong the useful life of the modified cardboard container and may allow for repeated reuse of a modified shipping container 2. This avoids the need of modifying a new modified container 2 each time it becomes necessary to replenish the dispensing device 1 with a fresh supply of coiled PEX conduit C.

The phantom lines of FIGS. 1-2 and 6A-6B depict a friction reducing liner which serves to reduce friction exerted by the coiled PEX conduit C internally against the container side walls 2S as it unwinds or uncoils within container 2. Interfacing pebbled surfaced plastic panels 2F cut to square onto the internal side panel walls 2S of the modified container 2 and equipped with axle receiving ports 2P may be suitably used for this purpose. Other mechanical, physical or chemical means for reducing the friction and drag created by the container 2, reel 3, reel axle 11, and coiled PEX conduit C such as mating axle bushings 3B such as depicted in FIGS. 8A and 8B may also used for this purpose.

The need for a supportive frame 5 to support reel 3 and the suspending member 9 depends primarily upon whether or not the container 2 used to house or contain the coiled PEX conduit C provides sufficient structural strength to support reel 3 and suspending member 9 under the rigorous physical abuses normally encountered by the container 2 at the construction site. If the container 2 lacks sufficient structural rigidity and strength to be hung from a floor joist BJ or I-beam BI and maintain its structural integrity with use, a frame 5 to support both the reel 3 and fragile container 2 may be effectively utilized for this purpose. When a modified cardboard shipping container 2 as shown in FIGS. 1-5 is used as the container 2, a supportive frame 5 will provide the needed structural support to suspend container 2 and serve to axle reel 3. The frame 5 in the embodiments of the invention as depicted in FIGS. 1-6B, serves both as a mount for mounting reel 3 and as a frame 5 for supporting the device 1 in a dispensing position. As previously mentioned, if the container 2 is constructed of a substantially rigid material such as of a wood, plastic or metal construction, the container 2 then by itself will inherently possess sufficient rigidity so as to maintain proper orientation of the reel 3 at a desired predetermined axis of rotation and therefore eliminate the need for frame 5.

The reel 3 may be mounted to a frame 5 or a container 2 in any manner which allows the reel 3 and coiled conduit to freely rotate within the container 2. The modified cardboard box container 2 as depicted in FIGS. 1, 2 and 5 may be fitted with axle shaft ports 2P positioned to mate onto reel axle mounting members 3M of frame 5 which in turn retains and suspends reel 3 about a fixed axis of free rotation. If the reel 3 fails to provided support so as to sufficiently clear the coiled PEX conduit C from internally rubbing upon the bottom inner panel member 2B or the inner side panel member 2S, excessive drag against unreeling of the coiled PEX conduit C from the container 2 may arise. By maintaining a reel 3 having a fixed axis of substantially free rotation, the spooled coiled conduit C may be uniformly maintained along a constant uncoiling pathway without substantial uncoiling resistance so as to permit effective uncoiling and unreeling of the conduit C from the container 2. The friction reducing side panels 2L mentioned above reduces side panel 2S drag. By maintaining the coiled PEX conduit C at a constant unreeling position, the coiled PEX conduit C becomes much less prone to prematurely uncoiling and snarling especially when an excessive withdrawing force is being applied against the coiled PEX conduit C and the rotating reel 3. As the coiled PEX conduit C is unwound, the reel 3 will inherently maintain sufficient drag or tension so as to permit the PEX conduit C to be tautly strung through or across the floor joists for fastening or anchoring thereto. The lubricity of the coiled PEX conduit C assists in the uncoiling of the PEX coil C from reel 3.

Figure 6A:
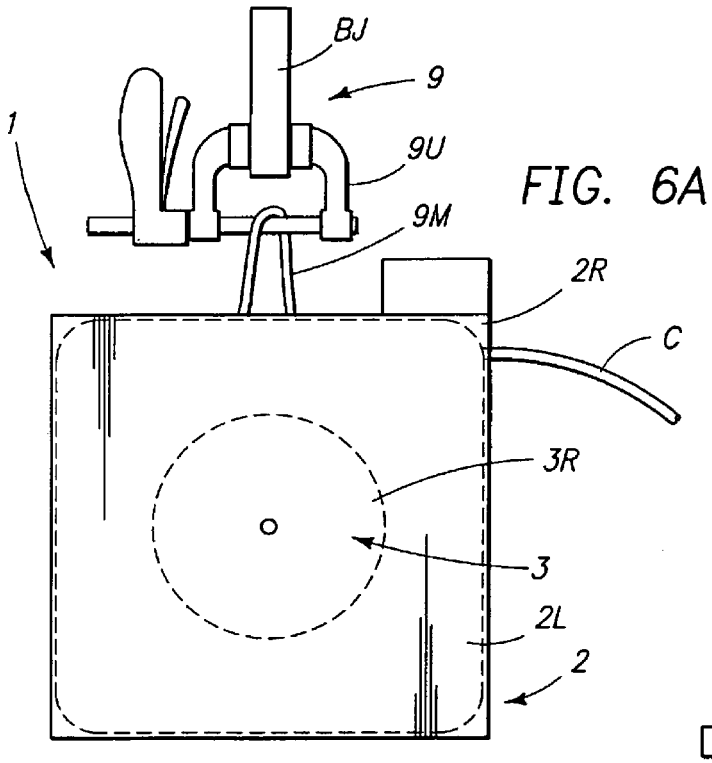
FIG. 6A depicts another embodiment of the dispensing device shown in FIG. 1 equipped with a different suspending member.
Figure 6B:
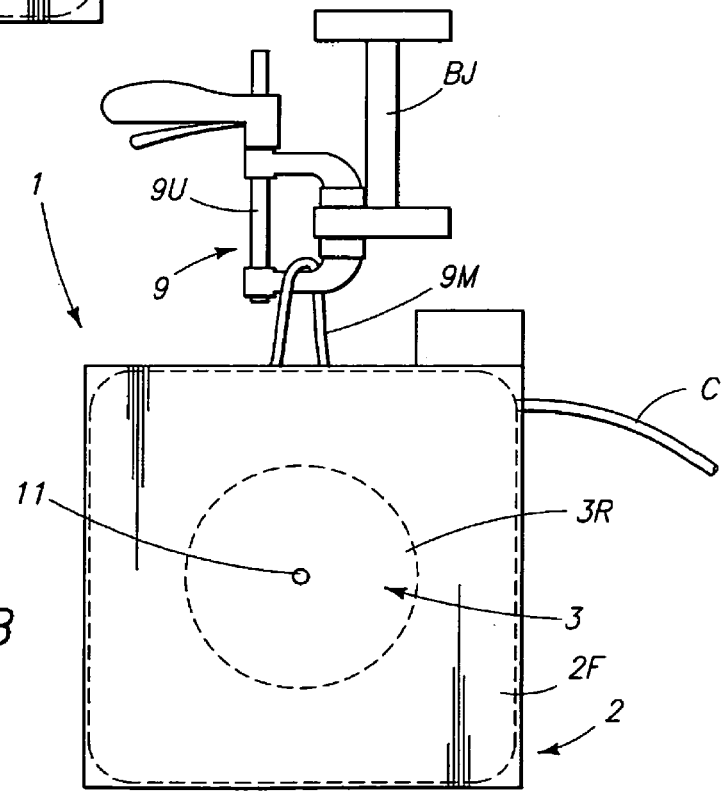
FIG. 6B depicts the dispensing device of FIG. 6A suspended from an I-beam.

The suspending member 9 of the dispensing device 1 may be of any form or structure which allows the dispensing device 1 to be suspended at the work site at the predetermined dispensing position. The suspending member 9 need not be fully incorporated into the design of the dispensing device 1. It may be simply in the form of a hook bar strap, etc., which permits suspending the device 1 to places at a dispensing position. The dispensing device 1 will most usually includes a suspending mount 9M which permits the suspending member 9 to position the dispensing device 1 at the appropriate dispensing position. The dispensing mount 9M generally provides a mounting or engaging site to allow the suspending member 9, in general, to engage and suspend the dispensing device 1 at the dispensing position. The suspending mount 9M may be incorporated into the frame 5. As depicted by FIGS. 8 and 9, the container 2 or the container jacket 2J may be configured, designed, or molded into the structure to serve as a suspending mount 9M for the suspending member 9. The suspending mount 9M may simply comprise a hook, loop, receptacle, eyelet bar, latch, etc., attached to a supportive frame 5 (e.g. see FIGS. 1-5) or onto a more durable container 2 or container jacket 2J fitted with an integrated mount 9M as depicted by FIGS. 8 and 9. Illustrative suspending members 9 to be used in combination with the suspending mount 9M include flexible suspending members 9 such as a strap, rope, a snap fastener and buckle, a hanger 9H, etc., which may be tied, nailed or otherwise attached to a floor joist BJ or I-beam BI (e.g. see FIGS. 1-5, 7A and 7B) or by a mechanical clamp 9 as illustrated by FIGS. 6A and 6B. The suspending mount 9M may simply be a mounting bar which also serves as a carrying handle for the container 2 or container jacket 2J depicted by FIGS. 8 and 9.

For most light commercial and residential applications, the dispensing device 1 will be suitably positioned at a securely anchored position such as being suspended from a floor joist BJ or I-beam joist BI which, in turn, allows the coiled PEX conduit C to be installed or dispensed at the desired dispensing position. The dispensing position aligns the dispensing device 1 in substantial longitudinal alignment with the PEX conduit C such as when strung along the floor joist BJ or I-beams BI as depicted by FIGS. 1-6B. The suspending member 9 positions the dispensing device 1 at a suitable dispensing position which in turn allows a single site worker to effectively uncoil or unreel and string the coiled PEX conduit C from the container 2. The type of suspending member 9 used at the construction site will depend, in part, upon the characteristics of the coiled PEX conduit C as it relates to the work site. If coiled PEX conduit C consists of the larger and heavy rolls of coiled PEX conduit C (e.g. in length and diameter), the supportive joist structure (e.g. 2"×10" floor joists BJ or I-beams BI) may lack the required structural strength to support such weighty PEX conduits C. Under such circumstances, it may be desirable to use a floor grounded suspending member 9 (e.g. a hoist) to support the dispensing device 1. For most applications involving the more common lighter PEX coiled conduits for residential and light commercial constructions, a hanger 9H such as the hanger bolt 9B and nut hanging head 9N looped onto a snap fastener 9F for hanging the dispensing device 1 from a mounting plate 9P nailed to floor joists BJ and I-beams BI as illustrated by FIGS. 1-5 or other suspending techniques as depicted by FIGS. 6A, 6B, 7A and 7B may serve to mount the dispensing device 1 at the uncoiling dispensing position.

Containers 2 which lack sufficient strength to resist manual shearing when exposed to opposing shear forces (e.g. such as the modified cardboard shipping containers 2 for the coiled PEX conduits C) may be suitably equipped with a bracketing frames 5 which includes (as depicted in FIGS. 1-5) a top panel retaining guide 7 bracketed by a pair of bracketing forked legs 5L for retaining the container 2 with the coiled PEX conduit C at a desired predetermined dispensing position for effective unwinding and stringing of the uncoiled PEX conduit C from the container 2. As may be observed from FIGS. 1-5, the retaining guide 7 of the bracketing frame 5 may be any type of guide 7 which in cooperative combination with the suspending member 9 aligns the dispensing container 2 at an appropriate dispensing position for stringing PEX conduit C therefrom. The depicted retaining guide 7 as shown in FIG. 1-5, is adapted to engage and retain the top panel 2T at a fixed hanging or suspending relationship. The illustrated retaining guide 7 includes a pair of side panel guides 7S and a pair of top panel frame bridges 7T which are adapted to engage onto the top panel 2T of the dispensing container 2 and thereby position the dispensing device 1 at an appropriate dispensing position. The lateral distance between the side panel guides 7S may be correspondingly sized to match the modified container 2 width for the particular coiled PEX conduit C being dispensed therefrom.

Figure 4:
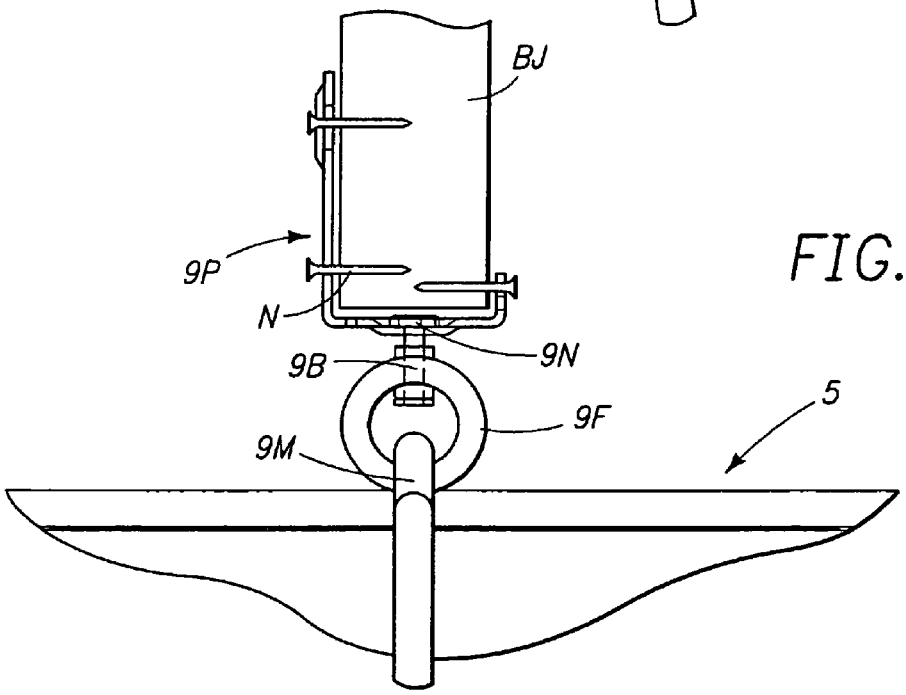
FIG. 4 is a side view of FIG. 3.
Figure 7A:
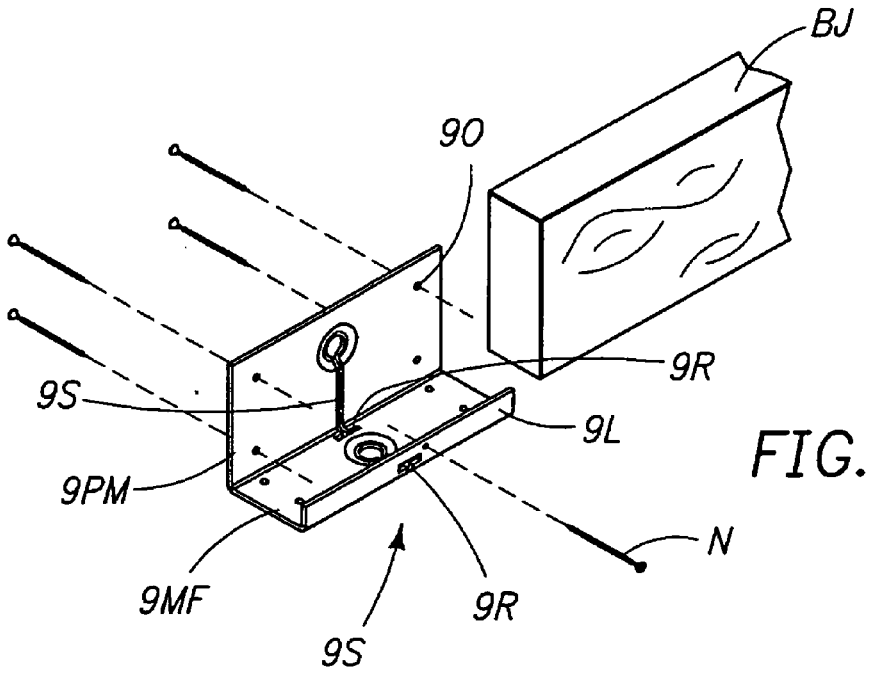
FIG. 7A is an enlarged elevational side view depicting in greater detail the mounting plate for mounting the dispensing device shown in FIG. 1.
Figure 7B:
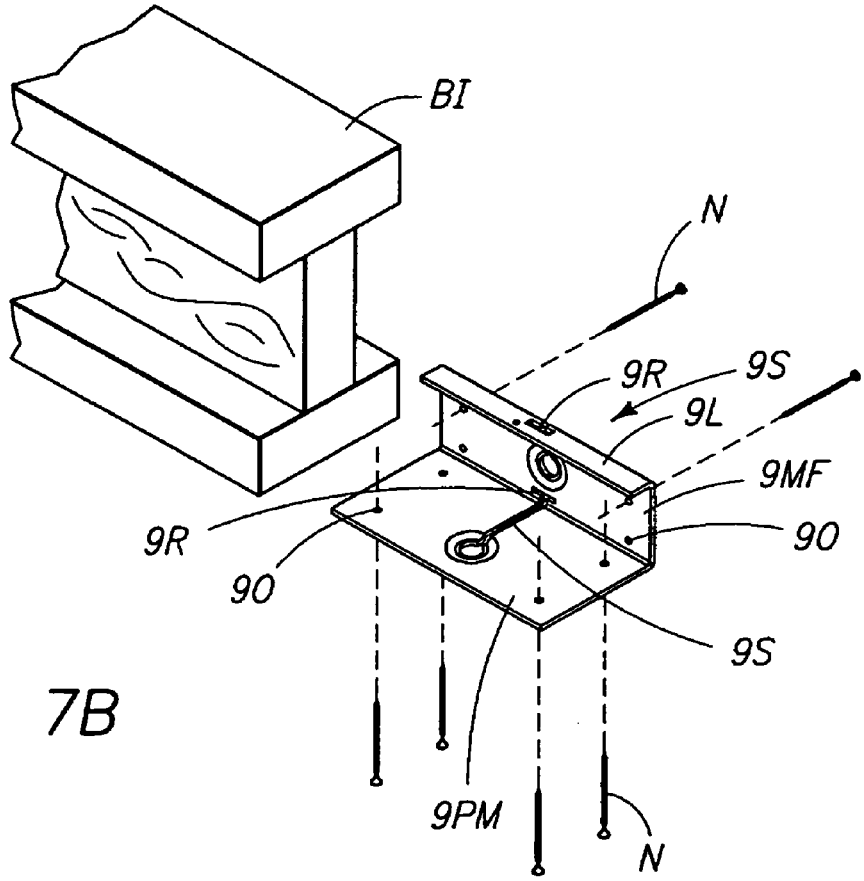
FIG. 7B is an elevational side view illustrating the mounting plate shown in FIGS. 7A positioned for mounting onto an I-beam.

The frame 5 is suitably equipped with a mounting member 9M for mounting to the dispensing device 1 at a dispensing position at the work site. The depicted mounting member 9 for frame 5 comprises a notched loop which serves to permit the dispensing device 1 to be mounted such as illustrated by FIGS. 2-4. A number of different types of suspending members 9 such as the depicted hangers 9H may be effectively utilized to hang the dispensing device 1 of this invention. FIGS. 1-5, 7A and 7B further depict effective means of suspending or mounting member 9 for mounting the dispensing device 1 at a dispensing position. The mounting member 9 as depicted by FIGS. 1-5, 7A and 7B includes a mounting plate 9P which is configured and equipped with nail holes 9*o* for nailing plate 9P onto either a floor beam joist BJ (e.g. 2"×12" such as a beam) or an I-Beam BI. The mounting plate 9P includes a major face plate 9PM with nailing apertures 9*o* for nailing the major face plate 9PM with nails N onto a vertical face of a floor joist beam BJ. A minor face plate 9MF rests in a perpendicular relationship to the major face plate 9PM is similarly equipped with nailing apertures 9*o* terminated by a transversal positioned lip 9L. The major face plate 9PM and or minor face plate 9MF are designed to interfacially mate onto and be nailed with nails N onto the joist beam BJ as depicted by FIGS. 1-4 and 7A. By simply rotating the major face plate 9PM by 90 degrees counter-clockwise so that the major face plate mount 9PM interfaces onto the bottom of an I-beam joist BI, the mounting plate 9P may be then correspondingly nailed onto the I-beam BI as illustrated by FIG. 7B.

Both the major 9PM and minor 9MF face plates are equipped with guide slots 9S adapted to receive and suspend the head of a nut 9N anchored or threaded onto a hanger bolt 9B. The opposite end of the hanger bolt 9B may be equipped with a swivel which allows the snap fastener 9F to be fastened onto the mounting member 2M. A head receiving port 9R in the minor mounting plate 9MF allows the hanging nut 9N of hanging bolt 9B to slide and engage onto hanger guide slots 9S for suspending the hanging member 9 to an I-beam BI. The head receiving port 9R in both the major 9PM and minor 9MF mounting plates allows the suspended head 9N to be slideably mounted and suspended by guide slots 9S for regular beam joists BJ as shown in FIGS. 1-5 and 7A. When it is desired to mount the mounting plate 9P to either an I-beam BI or 2×10 floor joist BJ, the mounting plate 9P is nailed with sufficient clearance to allow the threaded nut or head 9N to slide freely through the head receiving port 9R and along the guide slots 9S. This allows the frame suspending mount 9M or container mount 9M to be secured or hung from either an I-beam BI or floor joist beam BJ.

FIGS. 6A and 6B depict another embodiment for suspending the dispensing device 1 utilizing an adjustable u-clamp 9U to secure the dispensing device 1 to an I-beam BI or floor joist BJ at the dispensing position. The mounting member 9M may simply comprise a rope, strap or cable for hanging the dispensing device 1 into the floor joist BJ or I-beam BI.

With reference to FIGS. 1-5, frame 5 serves to support both hanger 9 and the reel 3 with the spooled coiled PEX conduit C. In contrast to the dispensing device 1 shown in FIGS. 1-5, there is depicted in FIG. 9, a versatile container jacket 2J suitably constructed of a durable metal or high impact plastic material sized to house and jacket either a modified cardboard shipping container 2 as depicted in FIGS. 1-5, the adjustable reel embodiments of FIGS. 8, 8A, 8B, 8C, and 8D, or a prefabricated cassette housing a reel 3 spooled with the coiled PEX conduit C sized to slide into jacket 2J. The container jacket 2J may be appropriately provided with an access port 2A for inserting and removing a modified shipping container 2 or prefabricated cassette and further equipped with at least one unreeling port 2R which correspondingly registers onto the unreeling port 2R of the modified shipping container 2 with or without registering axle ports 2P which, if desired, may correspondingly register onto the axle ports 2P of the modified container 2. The jacketed container 2 depicted in FIG. 9 includes a dispensing port 2R which allows for dispensing either from cornering margin of the top panel member 2T or lateral side panel member 2N. The container jacket 2J may be adapted to serve a multitude of purposes ranging from housing a modified container 2 instead of the frame 5, the adjustable reel embodiments to a container type cassette 2 as depicted in FIG. 9.

As may be observed from the Figures, the conduit dispensing device 1 generally comprises a container 2 for housing a coiled PEX conduit C, a reel 3 for unwinding the coiled PEX conduit C from the container 2 and a suspending mount 9 for suspending the conduit dispensing device 1 at a predetermined dispensing position such as illustrated in FIGS. 1-4, 6A, 6B, 6C, and 6D. In contrast to the frame supported container 2 depicted by FIGS. 1-6B, the container 2 or a container jacket 2J when constructed of a sufficiently durable and rigid construction (e.g. metal or plastic) may provide the basic structure for supporting both the reel 3 and the suspending mount 9M. The rigid container 2 also desirably includes a accessing member 2A for accessing onto the container 2 which may comprise an opening which allows the reel 3 to be loaded or unloaded with the coiled PEX conduit C. The reel axis 11 for the adjustable reel 3 depicted by FIGS. 8A and 8B and the reel axial hub 11P for the adjustable reel 3 of FIGS. 8C and 8D are designed to axially mount onto a pair of laterally disposed u-shaped channeled axial mounts 3M (shown as phantom lines in FIG. 8 and cross sectional FIG. 8B view) which serve to axially support of reel or the axle shaft projections 11P at the closed channel end.

The container 2 may be fitted with a suspending mounting member 9M which serves as a mount for suspending member 9 for the container 2. The suspending member 9 may be in a variety of forms such as a t-shaped engaging member 9H for slideable engagement onto the slotted passageway of mounting plate 9P of FIGS. 1-5, 7A, and 7B.

With particular reference to the adjustable reel 3 of FIGS. 8, 8A and 8B, reel spool 3RI is sized to fit within or mate onto the open cavity O of the coiled PEX conduit C. The cavity O for most coiled PEX conduits C as packaged and shipped from the factory will typically measure about fifteen inches in diameter. By sizing the spool 3RI of reel 3 slightly smaller (e.g. 13-14 inch diameter), the spool reel 3RI may easily inserted within coiled PEX conduit C while also serving as an effective reel 3 for the uncoiling of the coiled PEX conduit C by the dispensing device 1 herein. As the coiled PEX conduit C is withdrawn from the container 2, the coiled PEX conduit C will tend to be drawn against the reel spool 3RI which in turn maintains the coiled integrity of the uncoiled PEX conduit C as it is withdrawn and strung. The coiled PEX conduit C inherently imparts a lubricating effect which enhances the unreeling of PEX conduit C from the reel 3.

The reel 3 may be constructed of any material which provides a suitable reel for the unreeling of the coiled PEX conduit C from the dispensing device 1. The reel 3 serves to align the coiled PEX conduit C so that it may be effectively uncoiled in a form suitable for effective placement at the construction site. Any reel 3 serving this purpose may be used. The reel 3 need not be necessarily cylindrical in shape. An arcuate set of rollers (not shown) configured to receive and maintain the coiled PEX conduit C in an uncoiling position (e.g. aligned along the bottom of the container) may illustratively serve this purpose. The reel spool 3RI may be of an open structure such as a reel spool 3RI constructed of spooked brackets sized to spool the coiled PEX conduit C or a solid reel spool, the preferred solid reel 3 constructed of a variety of material such as plastics and metals as depicted in the Figures. Foamed materials of a cross-sectional width to mate onto the spooled PEX conduit C contribute little weight and may be effectively used as a reel 3 for the reel spool 3RI. Such foamed materials are light while also affording an adequate supportive core for the coiled PEX conduit C. Exemplary thereof are 4, 6 and 10 inch thick polyurethane foam spools 3RI of a 13-14 inch diameter dimensionally sized to loosely fit within the modified cardboard box packaging container 2. The reel shaft receiving mount 3M may include a sleeve lining or bushing 3B so as to protect the apertured reel mount 3M against premature abrasion or damage. The shaft receiving apertured mount 3M may further be further equipped with a bearing or bushing 3B (e.g. NYLON or TEFLON bushing) to facilitate the free rotational movement of reel 3. Similarly, the outer periphery of the reel 3 may be coated or wrapped with a circumscribing liner 3L to protect the coiled PEX conduit C from the abrasively damaging reel spool 3RI. A reel 3 of a more durable manufactured construction (e.g. plastic or metal etc.) such as the adjustable reel 3 depicted in FIGS. 8A, 8B, 8C, and 8D may be effectively serve this purpose. The reel 3 maintains the coiled PEX conduit C in proper alignment for controlled uncoiling and stringing at the job site while supporting the coiled PEX conduit C so as to reduce uncoiling friction and drag.

When using a less durable container 2 such as the cardboard shipping container depicted herein, the dispensing device 1 as mentioned hereinbefore may appropriately include the frame 5 equipped with a reel mounting member 3M which serves as a mount for mounting reel 3 to frame 5. The reel mounting member 3M provides the necessary structural integrity to axially support the reel 3 and reel axle 11. With particular reference to FIGS. 1-2 and 5, the depicted frame 5 includes a pair of forked legs 5L which extend downwardly along the side panels 2S of the modified packaging container 2 to the mounting position of the reel mounts 3M for the reel axle 11. Each of the forked legs 5L is equipped with a shaft receiving aperture 3M which serves as a reel mount for the axle shaft 11. The positioning of the shaft receiving apertures 3M upon each of the forked legs 5L is designed so as to suspend reel 3 sufficiently high enough so that a full coil of the coiled conduit clears the bottom 2B of the container 2.

When using a confining member 2 or container jacket 2J possessing sufficient strength to support a reel mounting member 3M, the shaft receiving member 3M of frame 5 as depicted in FIGS. 1, 2 and 5 may be replaced with an axle mount 3M integrated into the confining member 2 or container jacket 2J and although it would be more difficult to align the axle ports 2P onto similar ports (not shown) in the jacket 2J or container 2 with shaft 11, the container 2 and jacket 2J may be so equipped. The axle shaft 11 as shown in FIGS. 1-2, 5, 8A and 8B may be effectively replaced with an axle post or hub 11P which constructed so as to slideably engage onto the channeled axle mount 3M as depicted in FIGS. 8 and 8B. For example, the forked legs 5L may be provided with reel posts or sleeves (not shown) which may be fixed or slidably and transversely adjustable upon legs 5L so as to engage a recessed axle cavity mount in the reel 3.

If the container 2 is constructed of a durable metal or plastic, the container 2 may be most suitably designed to be opened so as to permit insertion of the coiled PEX conduit C, the reel 3 and reel axle 11 into or onto an axle mount 3M. This may be a container simply constructed of protruding split posts which allow a reel half (not shown) to be inserted into the open cavity of the coiled PEX conduit C and which when closed provides a fixed axle 11 for the reel 3. Alternatively, the bottom panel 2B may be partially or fully removed to alleviate dragging of the coiled PEX conduit C against the bottom panel 2B should the reel 3 not be properly positioned within the container 2. Instead of a cylindrical reel 3 supported by an axle 11, the bottom 2B of the container could be fitted with a series of axled rollers (not shown) which rest upon the coiled PEX conduit C during the unreeling operation.

The container 2 of FIG. 8 illustrates a dispensing device 1 designed to dispense coiled PEX conduits C of different sizes. As illustrated by the phantom lines, the container 2 of FIG. 8 is constructed of sufficiently durable materials to support an internally disposed axial reel mount 3M as well as a suspending hanger mount 9M. The depicted container 2 of FIG. 8 depicts an hinged access port 2A (which may be eliminated if desired) and a pair of conduit dispensing ports 2P. The Phantom lines of FIG. 8 depict a pair of laterally disposed channeled axle guides 3M which serve to support the axle shaft 11 or axial hub 11P when reel 3 and the spooled coiled PEX conduit C is channeled within channeled axle mount 3M until the axle shaft 11 (e.g. shown in FIGS. 8A and 8B) or axial hub 11P (e.g. as shown in FIGS. 8C and 8D) abuts onto the axle stops 3SP. As the coiled PEX conduit C is pulled outwardly through dispensing ports 2R, the axle shaft 11 or axial hub projections 11P for the FIGS. 8C and 8D reel will be biased against axle shaft or hub stops 3SP. In order to reduce frictional forces, bushings or bearings 3B may be emplaced onto the axle shaft 11 for counter sinking within axle bore 3RB of the reel spacers 3RO shown in FIG. 8A or the projecting axial hub 11P as depicted by FIG. 8B or onto the operational rotating abutting margin of the axle mount 3M.

The confining member 2 or container jacket 2J may be appropriately oversized in lateral width (i.e. 2N panel) so as to accommodate the different sized coiled PEX conduit C. FIGS. 8A, 8B, 8C, and 8D depicts adjustable reels 3 designed for use with the container 2 of FIGS. 8 using different width coiled PEX conduits C. The containers 2 depicted by FIGS. 8 and 9 and the reels 3 depicted in FIGS. 8, 8A, 8B, 8C and 8D are designed so as to accommodate coiled PEX conduits C of different sizes. The depicted containers 2 of FIGS. 8 and 9 are equipped with a mount 9M for the suspending member 9 and an axle mount 3M for axially mounting the reel shaft 11 shown in FIGS. 8A and 8B or the axle posts 11P to an uncoiling axle site. The container 2 or container jacket 2J may desirably include side panels 2S of a standardized size but laterally displaced sufficiently apart by top panel 2T, bottom panel 2B so as to accommodate the differently sized coiled PEX conduits C. The reel shaft mounts 3M as depicted by FIGS. 8 and 9 are depicted as accommodating either a reel axle 11 or axle posts 11P which may be suitably accomplished such as by the depicted two u-shaped channeled mounts 3M closed at a dispensing end 3SP (i.e. end by which the PEX conduit C is drawn from the container 2) and open at the opposite end so as to permit loading onto the shaft mount 3M the axle 11 or axle posts 11P for the reel 3 containing the coiled PEX conduit C. The container 2 is loaded through an open or hinged access port 2A positioned opposite of the unreeling port 2R. The container 2 may be otherwise equipped with similar features of the modified cardboard shipping container 2 of FIGS. 1-5.

With particular reference to FIGS. 8, 8A, 8B, 8C, and 8D, adjustable reels 3 adapted to receive and spool different sized conduit PEX coils C are depicted. With reference to FIGS. 8A and 8B, the depicted reel 3 includes two reel sidewalls 3S each having a centrally disposed reel aperture 3*o* for slidably adjusting and axially mounting the reel sidewalls 3S to reel shaft 11. The reel sidewalls 3S serve to maintain the coiled PEX conduit C upon the reel spool 3RI. Reel 3 may be equipped with a multiplicity of reel spacers (generally referenced by 3RO) of different sizes and a multiplicity of differently sized internally disposed reel spool 3RI adapted to match the lateral width of the coiled PEX conduit C (e.g. 4", 6", 10", etc.) being loaded onto reel 3. The two outwardly disposed reel spacers 3RO are selected upon the basis of the size of the internal reel spool 3RI used to spool the PEX conduit C which are collectively designed to rest somewhat flushingly against the axial mount 3M.

When loading the container 2 depicted in FIGS. 8 and 8B with coiled PEX conduit C, the reel 3 and the reel shaft 11 or projecting reel hub 11P are withdrawn from the container 2 sufficiently to clear the channeled axial mounting guides 3M. If the adjustable reel 3 of FIG. 8A is used, the appropriate internally disposed reel spool 3RI is inserted onto the reel shaft 11 coupled with placement of the coiled PEX conduit C onto the reel spool 3RI and placement of the two opposing reel sidewalls 3S and then an outwardly positioning of the two outwardly disposed reel spacers 3RO with fitted bushings 3B onto shaft 11. The reel shaft 11 with the loaded reel 3 including the reel sidewalls 3S fitted with the appropriate spacers and spools (e.g. 3R, 3RI and 3RO) and bushings 3B are then emplaced or loaded onto axle mounting member 3M until it rests against the axle mounting member guide stops 3SP.

In FIG. 8A, there is disclosed a wider reel spool 3RI, for the wider conduit PEX coils which is correspondingly adapted for use in combination with narrow width spacers 3RO. Conversely, the narrower spool 3RI is adapted for use with the wider spacers 3RO. Depending upon the lateral width of the coiled PEX conduit C, either the wider or narrower spool 3RI is chosen along with the appropriate outer reel spacer 3RO. As may be observed from the cross-sectional view of the container 2 and reel 3 of FIG. 8, the reel spacers 3RO are designed to rest flushly against bushings 3B which axles onto axle mount 3M and oppositely nestled snuggly against the reel sidewalls 3S with the reel spool 3RO being sandwiched therebetween. Since the coiled PEX conduit C becomes stiffer in cold weather, a heater 17 for heating the coiled PEX conduit C is housed within the dispensing container 2 is shown in FIG. 8B.

Another adjustable reel 3 adapted for use in conjunction with the confining member or container 2 of FIG. 8 or jacket container 2J allows for the reeling of at least two different sized PEX conduit coils C as further disclosed in more detail by the exploded cross sectional views of FIGS. 8C and 8D. The reels 3 depicted by FIGS. 8C and 8D include identical component parts, the only difference being in the manner in which the three components may be arranged to form reel 3. The reel sidewalls 3S are each equipped with a spool bed extender 3E designed to abut against the reel spool 3RI for a wider spool bed width as illustrated by FIG. 8D. For the smaller width coiled PEX conduits C, the reel bed extenders 3E are placed outwardly so that the reel sidewalls 3S rest flushly against the reel spool 3RI as depicted by FIG. 8C. The reel spool 3RI includes two laterally disposed recessed shaft receiving ports 3P for axially receiving axle shaft or hub projections 11P. Both sides of the spool bed extenders 3E and reel sidewalls 3S include axle or hub projections 11P which resting axial alignment with the axle receiving port 3P. The axle shaft projections 11P are designed to interfacially socket within the shaft receiving ports 3P while also serving as an axial site when slideably axled onto the channeled axial mounting guides 3M of the container 2 shown in FIG. 8. Simply by inverting the reel sidewalls 3S inwardly or outwardly upon reel spool 3RI, the spool width may be adjusted to accommodate different sized PEX conduit coils C. The axle shaft projections 11P may be jacketed or constructed of a friction reducing bushing (e.g. Teflon, nylon, etc) or bearing to reduce friction and drag.

FIG. 9 depicts a container jacket 2J which may be either used by itself to house a coiled PEX conduit C or house the modified cardboard shipping container 2 illustrated by FIGS. 1-5 or the adjustable reels 3 of the FIG. 8 series of drawings. The container 2 of FIG. 9 will desirably be oversized in lateral width so as to accommodate different sized PEX coils and, if desired, the adjustable reel 3 features such as depicted by FIGS. 8, 8A, 8B, 8C, and 8D. Since adequate clearance is provided for the unreeling coiled PEX conduit spool C as depicted by FIGS. 7-8D, the friction reducing side panel liner inserts 2L of FIGS. 1-5 may be eliminated.

The dispensing device 1 of this invention may be utilized by contractors and subcontractors in installing, repairing or modifying new or exiting utility systems. The dispensing device 1 is particularly heavily applicable to cross-linked coiled utility conduits of thermoset properties which are commonly bound together with binding straps at the manufacturing site and shipped in cardboard shipping containers to the work site. Exemplary of such prepackaged flexible coiled conduits which are generally adapted to be uncoiled at the work site include fuel conduits such as flexible stainless steel liquid petroleum and natural gas fuel conduits, coiled thermoset cross-linked plastic water tubing such as the cross-linked high density polyethylene, polypropylene, polybutylene thermosets, and the like. The dispensing device 1 is particularly useful within the field of plumbing systems which rely upon PEX conduits C which possess sufficient coiled memory characteristics to retain its coiled conduit character when coiled but may be uncoiled sufficiently so as to permit lineal installation at the plumbing site.

What is claimed:

1. A precoiled cross-linked polyethylene (PEX) pipe dispensing device for dispensing an unstrapped precoiled cross-linked polyethylene (PEX) pipe having an internal open cavity about which cross-linked polyethylene (PEX) pipe is precoiled, with said precoiled PEX pipe being unbound from binding straps used to bind and prevent an uncoiling of the precoiled PEX pipe, said dispensing device consisting essentially of the unstrapped precoiled cross-linked polyethylene (PEX) pipe and a substantially rigid enclosed confining member sized to retain and contain the unstrapped precoiled PEX pipe from a premature uncoiling, with said confining member being further equipped with laterally disposed sidewalls for laterally confining the unstrapped precoiled PEX pipe therewithin, a detachable reel having an insertable spool sized of a smaller size than the internal open cavity so as to mate within said open cavity and thereby suspend said unstrapped precoiled PEX pipe within said confining member, with said confining member and said detachable reel serving to confine the unstrapped precoiled PEX pipe within said confining member and thereby permit an uncoiling of the unstrapped precoiled PEX pipe therefrom when the device with said unstrapped precoiled PEX pipe and said reel are placed in an uncoiling position, a mountable reel axle upon which the detachable reel and the insertable spool revolve, axial mounts for axially mounting the reel axle between said sidewalls, a suspending member for placing the sidewalls of the PEX pipe dispensing device in a vertically aligned position and thereby suspend the dispensing device at a vertically aligned dispensing position at a work site, a dispensing port positioned in substantial directional alignment with the unstrapped precoiled PEX pipe so as to permit the uncoiling of the unstrapped PEX pipe therefrom, and an accessing port which allows for a placement and a removal of the unstrapped precoiled PEX pipe from the detachable reel and said confining member.

2. The precoiled PEX dispensing device according to claim 1 wherein the device houses a cardboard shipping container used for packaging and shipping a strapped precoiled PEX pipe therewithin, with said shipping container being equipped with a pair of laterally disposed sidewalls separated by a bottom wall and a top wall modified to include: a) the dispensing port for dispensing the unstrapped precoiled PEX pipe from the shipping container, b) oppositely positioned axial ports within each of said sidewalls for axially porting said reel axle thereto and c) a pair of friction reducing side panel inserts interfacing onto the sidewalls for reducing friction caused by the unstrapped precoiled PEX pipe rubbing against the sidewalls of the cardboard shipping container.

3. The dispensing device according to claim 2 wherein the precoiled PEX pipe dispensing device includes a rigid jacket for jacketing the cardboard shipping container therewithin, with said jacket including the axial mounts for axially mounting the mountable reel axle thereto and, the detachable reel includes the unstrapped precoiled PEX pipe confined within said container and inserted upon the insertable spool at the uncoiling position, and the suspending member includes a floor joist suspending mount mounted to the rigid jacket so as to permit the dispensing device to be suspended upon a floor joist at the vertically aligned dispensing position.

4. The PEX pipe dispensing device according to claim 3 wherein the rigid jacket and the detachable reel are adjustably sized so as to accommodate the uncoiling of at least two different sizes of the unstrapped precoiled PEX pipe therefrom and the cardboard shipping container includes a pair of friction reducing sidewall inserts to reduce friction created by the unstrapped precoiled PEX pipe uncoiling therefrom.

5. The dispensing device according to claim 1 wherein the device includes a hanger for vertically hanging the device to a floor joist.

6. The dispensing device according to claim 1 wherein the hanger includes an anchoring member for anchoring the hanger to an I-beam floor joist.

7. The dispensing device according to claim 1 wherein the substantially rigid container consists essentially of a rigid container equipped with the laterally disposed sidewalls having the axial mounts positioned upon said sidewalls at a substantially fixed axle mounting site for axially mounting of the reel axle thereto.

8. The dispensing device according to claim 7 wherein the adjustable reel includes an adjustable variable sized insertable spool adjustable to a spool width size so as to accommodate unstrapped precoiled PEX pipe coils of a varying coil width with said adjustable variable sized insertable spool being adjusted to the spool width size so as to accommodate the varying coil width of unstrapped PEX pipe supported thereupon within said container.

9. The precoiled PEX pipe dispensing device according to claim 7 wherein the rigid container houses a heating element for heating so to reduce thermal stiffness of the unstrapped precoiled PEX pipe housed therewithin.

10. The PEX pipe dispensing device according to claim 1 wherein the confining member consists essentially of a rigid container sized to accommodate at least two different sizes of the unstrapped precoiled PEX pipe, with said container having the laterally disposed sidewalls equipped with the axial mounts for the axially mounting of the mountable reel axle thereto, the detachable reel includes an adjustable reel adjustable so as to accommodate the at least two different sizes of the unstrapped precoiled PEX pipe, the PEX pipe dispensing device includes at least one size of the unstrapped precoiled PEX pipe inserted onto the insertable spool, and the dispensing port is positioned along an upper margin of the container so as to be in substantial longitudinal alignment with the unstrapped precoiled PEX pipe uncoiling from said reel and said dispending device.

11. A method for dispensing from a PEX pipe dispensing device an unstrapped precoiled cross-linked polyethylene (PEX) pipe having an internal cavity about which the PEX pipe is precoiled, said PEX pipe dispensing device consisting essentially of an enclosed confining member equipped with laterally disposed sidewalls, a bottom wall and a top wall for confining and retaining the unstrapped precoiled PEX pipe therewithin, a dispensing port for dispensing the unstrapped precoiled PEX pipe from the confining member, with said dispensing port being positioned along an upper margin of the confining member so as to be in substantial alignment with the unstrapped precoiled PEX pipe uncoiling therefrom, a suspending member for suspending the PEX pipe dispensing device and vertically aligning the sidewalls of the device and the unstrapped precoiled PEX pipe in a vertically aligned dispensing position at the work site, a detachable reel equipped with an insertable spool sized of a smaller size than the cavity so as to mate onto the cavity of said unstrapped precoiled PEX pipe, a reel axle about which the reel and the insertable spool revolve, axle mounts oppositely positioned about said sidewalls for axially mounting the reel axle thereto and an accessing port which allows for accessing within the confining member so as to permit a placement and a removal of the unstrapped precoiled PEX pipe from said insertable spool and said confining member, said method consisting essentially of:

A) accessing onto said confining member through said accessing port;

B) inserting the unstrapped precoiled PEX pipe onto said insertable spool of said reel;

C) emplacing the reel axle and the insertable spool of said reel with the unstrapped precoiled PEX pipe inserted upon the spool onto the axle mounts for said reel so as to position the precoiled PEX pipe in an uncoiling position;

D) enclosing the accessing port with the unstrapped precoiled PEX pipe within the enclosed confining member so as to confine and retain the unstrapped precoiled PEX pipe therewithin;

E) suspending at the work site the PEX pipe dispensing device at the vertically aligned dispensing position while maintaining the dispensing port in substantial longitudinal alignment with the unstrapped precoiled PEX pipe uncoiling from said reel;

F) uncoiling and stringing the precoiled PEX pipe at the uncoiling position from said dispensing port onto an anchoring site to provide a string of uncoiled PEX pipe at the work site; and G) anchoring the string of uncoiled PEX pipe onto the anchoring site at the work site.

12. The method according to claim 11 wherein the suspending member includes a floor joist anchoring member for anchoring the device onto a floor joist at the work site and the unstrapped precoiled PEX pipe is initially bound together with shipping straps and the method includes as additional method steps an initial unbinding of the shipping straps from the precoiled PEX pipe to provide the unstrapped precoiled PEX pipe, followed by the inserting of the unstrapped precoiled PEX pipe onto the insertable spool of the reel, placing the spool with the unstrapped precoiled PEX pipe inserted thereupon onto the reel axle and axle mounts within said confining member, securing the anchoring member of the PEX pipe dispensing device onto a floor joist at the vertically aligned dispensing position at the work site and the uncoiling and the stringing of the uncoiled PEX pipe onto floor joists to provide the string of uncoiled PEX pipe along the floor joists while anchoring the string of the uncoiled PEX pipe onto the floor joists.

13. The method according to claim 12 wherein the reel comprise an adjustable reel and the method includes adjusting the adjustable reel to a predetermined reel spool size so as to matingly accommodate onto a coil size of the unstrapped precoiled PEX pipe.

14. The method according to claim 11 wherein the enclosed confining member consists of a rigid confining member equipped with a floor joist suspending mount mounted onto a top wall of the rigid confining member so as to permit for a mounting of the suspending member at the work site, the laterally disposed sidewalls include the axle mounts for mounting the reel axle thereto and the method includes the steps of: a) the suspending of the dispensing device onto a floor joist at the vertically aligned dispensing position and the uncoiling position; b) maintaining the dispensing port in substantial longitudinal alignment with said floor joist and other anchoring floor joists while uncoiling the unstrapped precoiled PEX pipe from said PEX pipe dispensing device so as to provide an uncoiled PEX pipe, and c) the stringing of the uncoiled PEX pipe onto the anchoring floor joists to provide the string of uncoiled PEX pipe along said floor joists and the anchoring of the string of the uncoiled PEX pipe onto said anchoring floor joists.

* * * * *